US007144094B2

(12) United States Patent
Chung

(10) Patent No.: US 7,144,094 B2
(45) Date of Patent: Dec. 5, 2006

(54) METHOD AND APPARATUS FOR INSPECTING HOME POSITION OF INK-JET PRINTER

(75) Inventor: Jin-tae Chung, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 329 days.

(21) Appl. No.: 10/673,482

(22) Filed: Sep. 30, 2003

(65) Prior Publication Data

US 2004/0113966 A1 Jun. 17, 2004

(30) Foreign Application Priority Data

Dec. 17, 2002 (KR) ..... 10-2002-0080874

(51) Int. Cl.
*B41J 29/393* (2006.01)
*B41J 23/00* (2006.01)

(52) U.S. Cl. ..... 347/19; 347/37

(58) Field of Classification Search ..... 347/14, 347/19, 37, 832; 400/283, 303
See application file for complete search history.

(56) References Cited

U.S. PATENT DOCUMENTS 6,257,781 B1 * 7/2001 Harris ..... 400/323
6,390,698 B1 * 5/2002 Yoshida et al. ..... 400/356

* cited by examiner

*Primary Examiner*—Thinh Nguyen
(74) *Attorney, Agent, or Firm*—Staas & Halsey LLP

(57) ABSTRACT

A method and an apparatus for inspecting a home position of an ink-jet printer carriage by moving the carriage in a first direction away from the home position until the carriage is not moved for a first predetermined period of time and determining a current position of the carriage as a first position using a maximum moving distance of the carriage. The method and apparatus include moving the carriage in a second direction towards the home position until the carriage is not moved for a second predetermined period of time and determining a current position of the carriage as a second position. If a distance between the first position and the second position is same as the maximum moving distance of the carriage and a second position is same as a second previously-determined position, a determination is made that an error does not exist in the home position.

18 Claims, 4 Drawing Sheets

METHOD AND APPARATUS FOR INSPECTING HOME POSITION OF INK-JET PRINTER

CROSS-REFERENCE TO RELATED APPLICATIONS

This application claims the priority of Korean Patent Application No. 2002-80874, filed on Dec. 17, 2002, in the Korean Intellectual Property Office, the disclosure of which is incorporated herein in its entirety by reference.

BACKGROUND OF THE INVENTION

1. Field of the Invention

The present invention relates to an ink-jet printer, and more particularly, to a method and an apparatus for inspecting errors of a home position in an ink-jet printer.

2. Description of the Related Art

Ink-jet printers perform a printing operation using a direct current (DC) motor. They generate information related to positions and a fire signal of a head using a sense signal output from an encoder sensor (not shown) installed behind a carriage (not shown). Here, the encoder sensor senses light irradiated from a light sensor (not shown) and then passing through an encoder strip having patterns in which black and white colors repeatedly appear, and generates a sense signal in a square wave shape at a level corresponding to the result of sensing. In this case, movement of the carriage, or works (processes) related to the carriage positions, are performed based on a home position information.

When power is initially applied to the ink-jet printers, they generate a sense signal while moving the carriage in a specific direction at a predetermined speed and convert the sense signal into a position. In this case, they recognize a position in which the carriage is not moved in a specific direction for a specific period of time, as an end position in a specific direction, which is the home position, and set the home position to an absolute position.

Hereinafter, in an ink-jet printer using a DC motor, a conventional method for calculating a carriage position using a sense signal will be described with reference to FIGS. 1A through 1C. FIG. 1A through FIG. 1C illustrate a conventional method for calculating a carriage position. FIG. 1A shows a waveform of a sense signal, FIG. 1B shows a waveform of a signal in which the sense signal is phase-transited by 90°, and FIG. 1C shows patterns of an encoder strip.

Counting of a position of a carriage starts at a rising edge of the sense signal shown in FIG. 1A. Thus, in the conventional method for calculating a carriage position, errors can occur in a calculated position according to the position of the carriage when the power is applied to the ink-jet printer carriage. For example, when the carriage is placed in positions 2, 3, and 4 of the encoder strip shown in FIG. 1C and these positions are set to absolute positions, counting of the position of the carriage starts in a position 5, which is a next rising edge of the sense signal shown in FIG. 1A. Therefore, for example, if an interval between black colors (or between white colors) is 1/150 inch and a unit of a position is 600 dots per inch (dpi) in the encoder strip, in the conventional method for calculating a carriage position, a maximum of 3/600 errors can occur according to a home position in which the carriage is not moved any more (i.e., an erroneous home position is calculated). Likewise, assuming that an alignment compensation value during a bi-directional printing operation is set using position information set when a power is initially applied to the ink-jet printer, if the ink-jet printer is turned off and then turned on, errors occur in a home position even though the alignment compensation value is stored, because the actual alignment compensation value would deviate from the set alignment compensation value during a bi-directional printing operation.

SUMMARY OF THE INVENTION

The present invention provides a method of inspecting a home position of an ink-jet printer by inspecting (determining) whether errors occur in a home position in an ink-jet printer that performs a printing operation using a direct current (DC) motor.

The present invention further provides an apparatus inspecting a home position of an ink-jet printer, in which the apparatus inspects (determines) whether errors occur in a home position in an ink-jet printer that performs a printing operation using a direct current (DC) motor.

Additional aspects and advantages of the invention will be set forth in part in the description which follows and, in part, will be obvious from the description, or may be learned by practice of the invention.

The present invention may be achieved by a method of inspecting a home position of an ink-jet printer carriage comprising moving the carriage in a first direction until the carriage is not moved for a first predetermined period of time and determining a current position of the carriage as a first position using a maximum moving distance of the carriage when the carriage is not moved for the first predetermined period of time, moving the carriage in a second direction until the carriage is not moved for a second predetermined period of time and determining a current position of the carriage as a second position when the carriage is not moved for the second predetermined period of time, when a distance between the first position and the second position is not the same as the maximum moving distance of the carriage, or when a second currently-determined position is not the same as a second previously-determined position, determining that errors exist in the home position, and when the distance between the first position and the second position is the same as the maximum moving distance of the carriage and the second currently-determined position is the same as the second previously-determined position, determining that errors do not exist in the home position. The first and second directions correspond to a direction opposite to the home position and a direction of the home position, respectively.

The present invention may be also achieved by an apparatus inspecting a home position of an ink-jet printer carriage driven by a direct current (DC) motor. The apparatus comprises a carriage movement unit which moves the carriage in a first direction opposite to a home position in response to a first control signal and a position determination signal or moves the carriage in a second direction in a direction of the home position, in response to a second control signal, a movement inspection unit which inspects whether the carriage is moved in the first direction, outputs the result of inspection as the first control signal, inspects whether the carriage is moved in the second direction, and outputs the result of inspection as the second control, a position determination unit which determines a current position of the carriage as a first position, using a maximum moving distance of the carriage in response to the first control signal, generates the position determination signal which indicates whether the first position is determined, and determines a current position of the carriage as a second position using the first position in response to the second control signal, a storage unit which stores the second position, a position addition unit which calculate the distance the first position and the second position, a first comparison unit which compares the distance input from the position addition unit with the maximum moving distance of the carriage and outputs the result of comparison as a first error determination signal, a second comparison unit which compares a second currently-determined position input from the position determination unit with a second previously-determined position read from the storage unit and outputs the result of comparison as a second error determination signal, in response to the first error determination signal, and an error determination unit which determines whether errors exist in the home position in response to the first and second error determination signals.

BRIEF DESCRIPTION OF THE DRAWINGS

The above and/or other aspects of the invention will become apparent and more readily appreciated from the following description of the embodiments taken in conjunction with the accompanying drawings in which.

DETAILED DESCRIPTION OF THE PREFERRED EMBODIMENTS

Figures 1A, 1B, 1C:
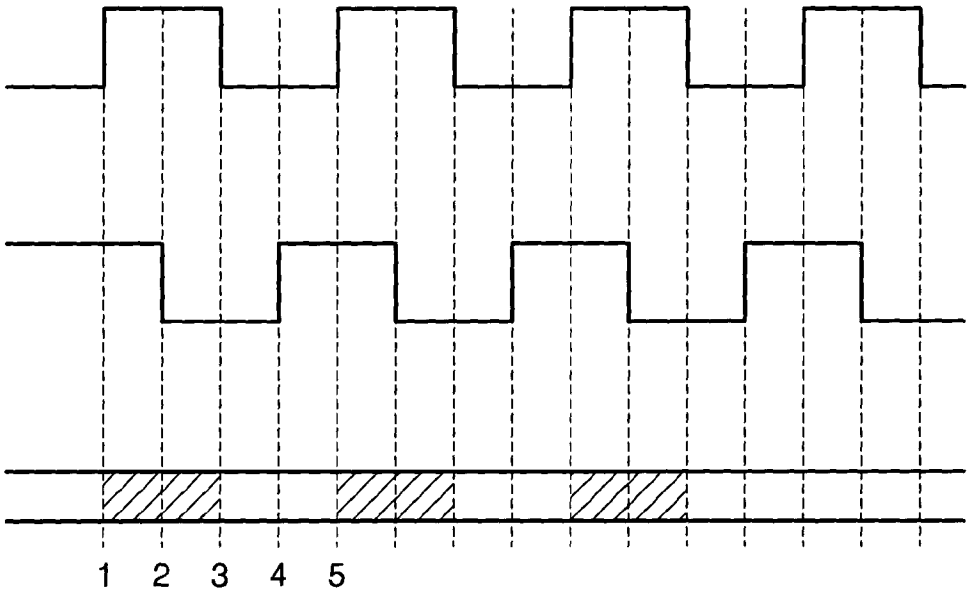
FIG. 1A (PRIOR ART)
FIG. 1B (PRIOR ART)
FIG. 1C (PRIOR ART)
FIGS. 1A through 1C illustrate a conventional method for calculating an ink-jet printer carriage position.

Reference will now be made in detail to the present embodiments of the present invention, examples of which are illustrated in the accompanying drawings, wherein like reference numerals refer to the like elements throughout. The embodiments are described below to explain the present invention by referring to the figures.

Figure 2A:
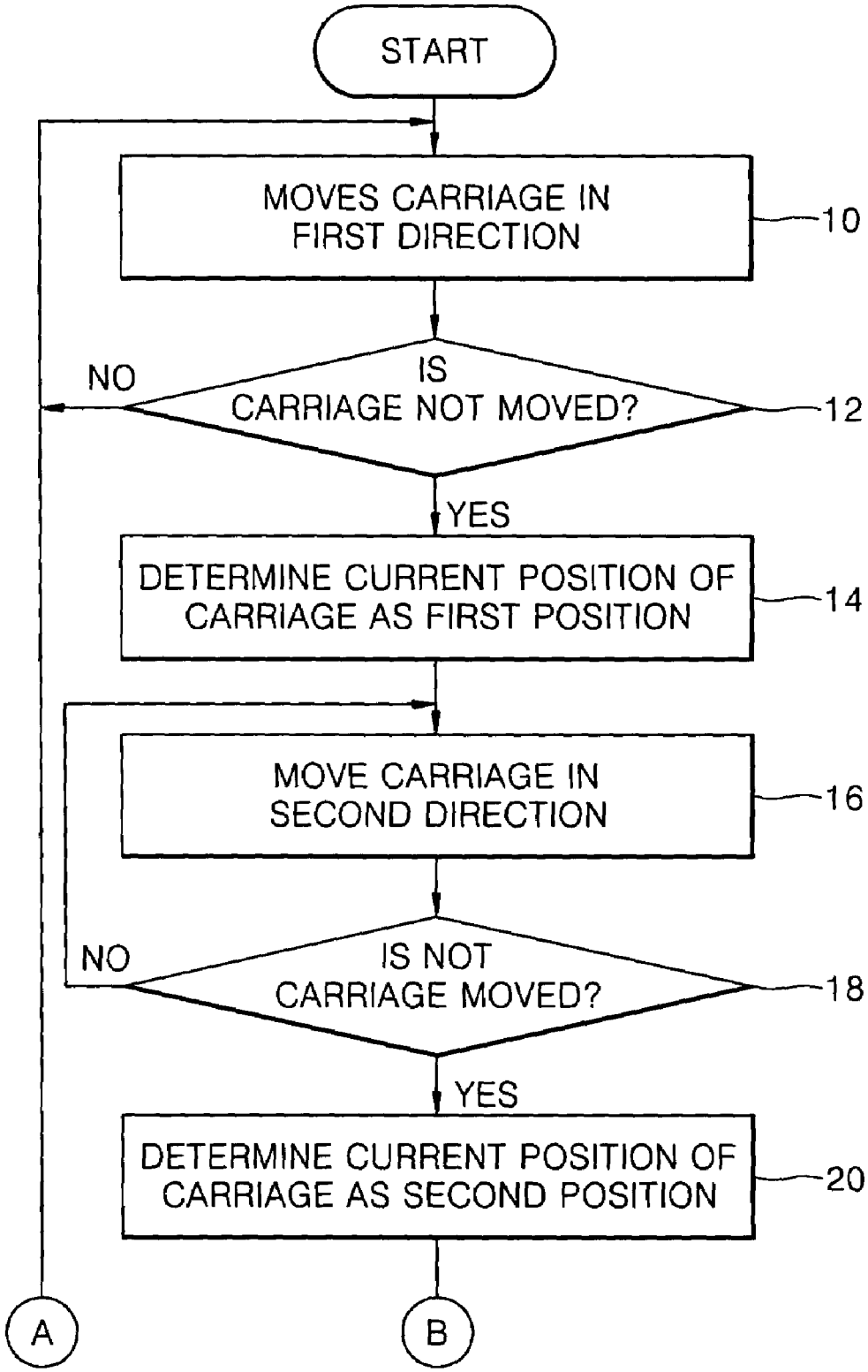
FIGS. 2A and 2B are flowcharts inspecting a home position of an ink-jet printer carriage, according to an embodiment of the present invention.
Figure 2B:
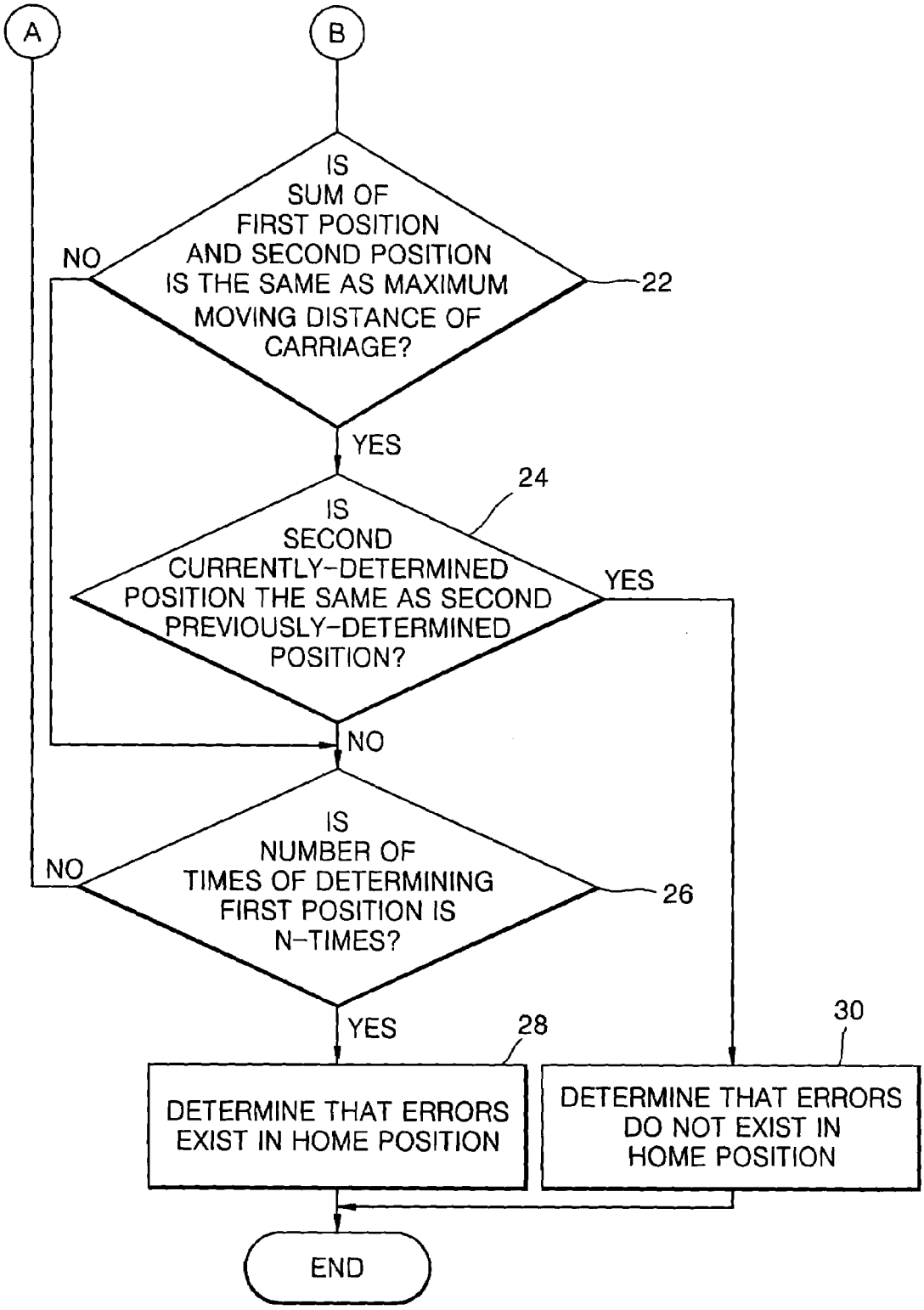

With reference to FIGS. 2A and 2B, a method of inspecting a home position of an ink-jet printer carriage (carriage), according to an embodiment of the present invention will be described. In FIG. 2A, operations 10 through 12 obtain a first position by moving the carriage in a direction opposite to (away from) a home position, operations 16 through 20 obtain a second position by moving the carriage in a direction towards the home position, and operations 22 through 30 determine errors of the home position using the obtained first and second positions. An ink-jet printer in which the method of inspecting a home position of the ink-jet printer carriage is implemented as shown in FIG. 2A according to the present invention, has a direct current (DC) motor (not shown) driving the carriage (not shown).

In operation 10, the carriage is moved in a first direction opposite to (away from) the home position of the carriage. At operation 12, it is judged whether the carriage is not moved in the first direction for a first predetermined period of time. If judged at operation 12 that the carriage is moved in the first direction for the first predetermined period of time, the method returns to operation 10. However, if judged at operation 12 that the carriage is not moved in the first direction for the first predetermined period of time, in operation 14, a current position of the carriage is determined as a first position P1 using a maximum moving distance of the carriage. Here, according to an aspect of the present invention, the maximum moving distance of the carriage may be the size of a frame installed on a moving route of the carriage.

In particular, according to an embodiment of the present invention, if judged at operation 12 that the carriage is not moved in the first direction for the first predetermined period of time, at operation 14, the maximum moving distance of the carriage is determined as the first position P1. Alternatively, according to another embodiment of the present invention, if judged at operation 12 that the carriage is not moved in the first direction for the first predetermined period of time, at operation 14, '0' is determined as the first position P1.

At operation 16, the carriage is moved in a second direction in a direction towards the home position of the carriage. In this case, as described above, if, at operation 14, the maximum moving distance of the carriage is determined as the first position P1, at operation 16, the carriage is moved in the second direction, and the first position P1 is counted downward. However, if, at operation 14, '0' is determined as the first position P1, at operation 16, the carriage is moved in the second direction, and the first position P1 is counted upward.

At operation 18, it is judged whether the carriage is not moved in the second direction for a second predetermined period of time. According to an aspect of the present invention, typically, the first predetermined period of time and the second predetermined period of time may be the same. If judged, at operation 18, that the carriage is moved in the second direction for the second predetermined period of time, the method returns to operation 16. However, if judged, at operation 18, that the carriage is not moved in the second direction for the second predetermined period of time, in operation 20, a current position of the carriage is determined as a second position P2 using the first position P1.

In this case, when in operation 16, the carriage is moved in the second direction and the first position P1 is counted downward, if judged at operation 18 that the carriage is not moved in the second direction for the second predetermined period of time, in operation 20, the result of downward-counting until the carriage is not moved any more is determined as the second position P2. However, when in operation 16, the carriage is moved in the second direction and the first position P1 is counted upward, if judged, at operation 18, that the carriage is not moved in the second direction for the second predetermined period of time, in operation 20, the result of the upward-counting until the carriage is not moved any more is determined as the second position P2.

Meanwhile, in operation 22 (see FIG. 2B), it is judged whether the distance between the first position P1 and the second position P2 is the same as the maximum moving distance of the carriage. In this case, if judged at operation 22 that the distance between the first position P1 and the second position P2 is the same as the maximum moving distance of the carriage, in operation 24, it is judged whether a second currently-determined position P2 is the same as the second previously-determined position P2.

According to a first embodiment of the present invention, as shown in FIG. 2B, if judged, at operation 24, that the second currently-determined position P2 is not the same as the second previously-determined position P2, or if judged at operation 22 that the distance between the first position P1 and the second position P2 is not the same as the maximum moving distance of the carriage, in operation 26, it is judged whether the number of times of determining the first position P1 is n-times. In this case, if judged at operation 26 that the number of times of determining the first position P1 is not n-times, the method returns to operation 10. However, if judged at operation 26 that the number of times of determining the first position P1 is n-times, in operation 28, it is determined that errors exist in the home position.

According to a second embodiment of the present invention, unlike that shown in FIG. 2B, if judged, at operation 22, that the distance between the first position P1 and the second position P2 is not the same as the maximum moving distance of the carriage, or if judged, at operation 24 that the second currently-determined position P2 is not the same as the second previously-determined position P2, in operation 26, it is judged whether the number of times of determining the second position P2 is n-times. In this case, if judged, at operation 26, that the number of times of determining the second position P2 is not n-times, the method returns to operation 10. However, if judged at operation 26 that the number of times of determining the second position P2 is n-times, in operation 28, it is determined that errors exist in the home position.

Therefore, to judge whether the method of inspecting a home position of an ink-jet printer carriage, as shown in FIG. 2B, is performed n-times, in the above-mentioned first embodiment, it is judged whether the number of times of determining of the first position P1 is n-times, and in the above-mentioned second embodiment, it is judged whether the number of times of determining the second position P2 is n-times.

According to a third embodiment of the present invention, unlike that shown in FIG. 2B, the method of inspecting a home position of an ink-jet printer carriage may not comprise operation 26. In this case, if judged, at operation 24, that the second currently-determined position P2 is not the same as the second previously-determined position P2, or if judged, at operation 22, that the distance between the first position P1 and the second position P2 is not the same as the maximum moving distance of the carriage, in operation 28, it is determined that errors exist in the home position.

Meanwhile, if judged, at operation 24, that the second currently-determined position P2 is the same as the second previously-determined position P2, in operation 30, it is determined that errors do not exist in the home position. In particular, an ink-jet printer home position error is not detected, if the distance between the first position P1 and the second position P2 equals the maximum moving distance of the carriage and the second currently-determined position equals the second previously-determined position.

According to an embodiment of the present invention, typically, if, in operation 20, the second position P2 is determined based upon the result of downward-counting of operation 16, which is carried out until the carriage is not moved any more, to judge, at operation 22, whether the distance between the first position P1 and the second position P2 is the same as the maximum moving distance of the carriage, it can be judged whether the second position P2 is the same as '0', because, at operation 14, the first position P1 was set to the maximum moving distance of the carriage. In this case, if judged, at operation 22, that the second position P2 is '0', the method proceeds to operation 24. However, if judged, at operation 22, that the second position P2 is not '0', it is determined that errors exist in the home position or the method proceeds to operation 26.

According to another embodiment of the present invention, typically, if in operation 20, the second position P2 is determined based upon the result of upward-counting of operation 16, which is carried out until the carriage is not moved any more, to judge, at operation 22, whether the sum of the first position P1 and the second position P2 is the same as the maximum moving distance of the carriage, it can be judged whether the second position P2 is the same as the maximum moving distance of the carriage, because, at operation 14 the first position P1 was set to '0'. In this case, if judged, at operation 22, that the second position P2 is the same as the maximum moving distance of the carriage, the method proceeds to operation 24. However, if judged, at operation 22, that the second position P2 is not the same as the maximum moving distance of the carriage, it is determined that errors exist in the home position or the method proceeds to operation 26.

Figure 3:
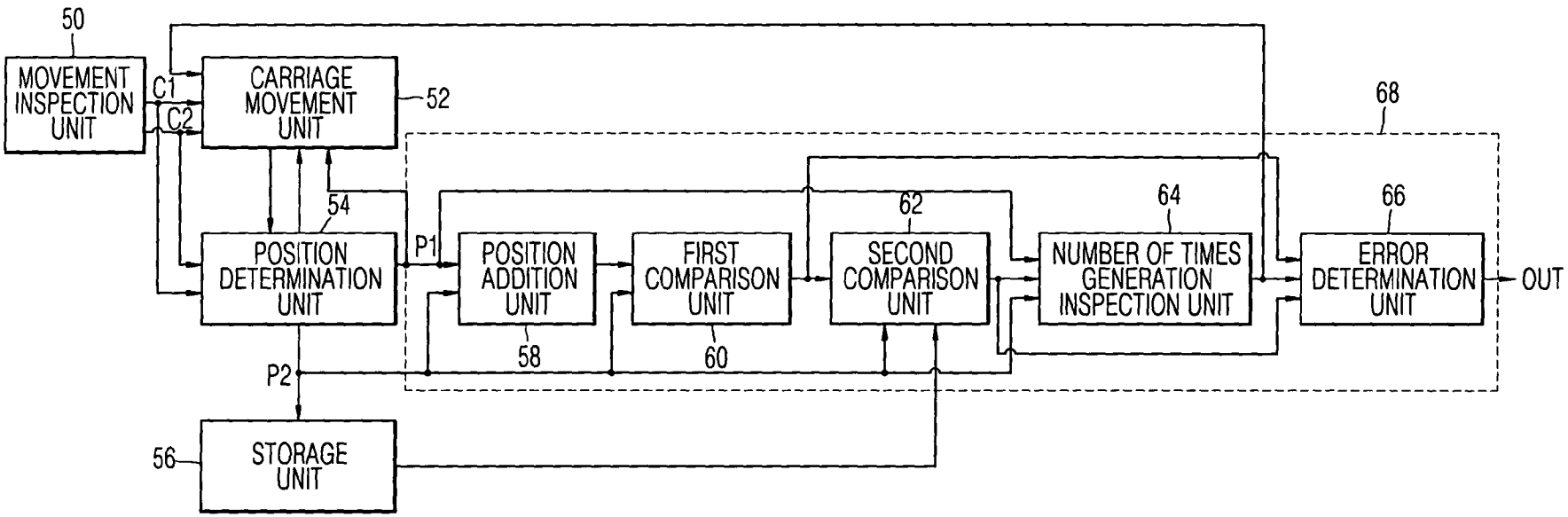
FIG. 3 is a functional block diagram of an apparatus inspecting a home position of an ink-jet printer carriage, according to an embodiment of the present invention.

FIG. 3 is a functional block diagram of an apparatus inspecting a home position of an ink-jet printer carriage, according to an embodiment of the present invention. The apparatus inspecting a home position of an ink-jet printer carriage comprises a movement inspection unit 50, a carriage movement unit 52, a position determination unit 54, a storage unit 56, a position addition unit 58, first and second comparison units 60 and 62, a number of times generation inspection unit 64, and an error determination unit 66. In particular, typically, the apparatus shown in FIG. 3 is an ink-jet printer implementing the method of inspecting the ink-jet printer carriage home position as shown in FIGS. 2A and 2B. Accordingly, the present invention can be implemented in software and/or computing hardware controlling a printer according to the above-described processes of the present invention as shown in FIGS. 2A and 2B.

To perform operation 10 shown in FIG. 2A, the carriage movement unit 52 moves an ink-jet printer carriage in a first position opposite to (away from) the home position of the carriage. For example, in an initial state, if a power is applied to the ink-jet printer, the carriage movement unit 52 moves the carriage in the first position. To perform operation 12, the movement inspection unit 50 inspects whether the carriage is moved in the first direction, and outputs the result of inspection to the carriage movement unit 52 and the position determination unit 54, respectively, as a first control signal C1. In this case, the carriage movement unit 52 continues moving the carriage in the first direction in response to (depending upon) the first control signal C1 input from the movement inspection unit 50. In particular, if it is recognized through the first control signal C1 that the carriage is moved in the first direction for a first predetermined period of time, the carriage movement unit 52 moves the carriage in the first direction.

To perform operation 14, the position determination unit 54 determines a current position of the carriage in response to the first control signal C1 input from the movement inspection unit 50 indicating that the carriage is not moved in the first direction for the first predetermined period of time, and outputs the first position P1. That is, if it is recognized through the first control signal C1 that the carriage is not moved in the first direction for the first predetermined period of time, the position determination unit 54 determines the first position P1. In this case, the position determination unit 54 determines the current position of the carriage as a first position P1 using a maximum moving distance of the carriage, outputs the determined first position P1 to the position addition unit 58 and the number of times generation inspection unit 64, respectively. The position determination unit 54 generates a position determination signal, which indicates whether the first position P1 is determined, and outputs the position determination signal to the carriage movement unit 52. The position determination signal from the position determination unit 54 indicates to the carriage movement unit 52 that the carriage may be moved in the second direction, because the first position P1 has been determined.

To perform operation 16, the carriage movement unit 52 begins moving the carriage in a second direction, in a direction towards the home position, in response to the position determination signal input from the position determination unit 54. In particular, if it is recognized through the position determination signal that the first position P1 is determined, the carriage movement unit 52 moves the carriage in the second direction. The carriage movement unit 52 also either counts down or up the first position P1 depending on a determined first position P1 (described in more detail below). To perform operation 18, the movement inspection unit 50 inspects whether the carriage is moved in the second direction, and outputs the result of inspection to the carriage movement unit 52 and the position determination unit 54, respectively, as a second control signal C2. In this case, the carriage movement unit 52 continues moving the carriage in the second direction in response to (depending upon) the second control signal C2 input from the movement inspection unit 50. In particular, if it is recognized through the second control signal C2 that the carriage is moved in the second direction for a second predetermined period of time, the carriage movement unit 52 moves the carriage in the second direction.

To perform operation 20, the position determination unit 54 determines the current position of the carriage as a second position P2 using the first position P1, in response to the second control signal C2 input from the movement inspection unit 50 indicating that the carriage is not moved in the second direction for the second predetermined period of time, and outputs the second position P2. That is, if it is recognized through the second control signal C2 that the carriage is not moved in the second direction for the second predetermined period of time, the position determination unit 54 determines the second position P2 using the first position P1.

To perform operation 22, the apparatus comprises the position addition unit 58 and the first comparison unit 60. Here, the position addition unit 58 calculates the distance between the first position P1 and the second position P2, which are input from the position determination unit 54, and outputs the result of calculation to the first comparison unit 60. For example, the first comparison unit 60 compares the distance between the first position P1 and the second position P2 input from the position addition unit 58 with the maximum moving distance of the carriage and outputs the comparison result to the second comparison unit 62 and the error determination unit 66, respectively, as a first error determination signal.

To perform operation 24 (see FIG. 2B), the apparatus comprises the storage unit 56 and the second comparison unit 62. Here, the storage unit 56 stores the second position P2 input from the position determination unit 54. In this case, the second comparison unit 62 compares a second currently-determined position P2 input from the position determination unit 54 with a second previously-determined position P2 read from the storage unit 56 in response to the first error determination signal input from the first comparison unit 60 and outputs the comparison result to the number of times generation inspection unit 64 and the error determination unit 66, respectively, as a second error determination signal. In particular, if it is recognized through the first error determination signal output from the first comparison unit 60 that the distance between the first position P1 and the second position P2 is the same as (equals) the maximum moving distance of the carriage, the second comparison unit 62 inspects whether the second currently-determined position P2 is the same as (equals) the second previously-determined position P2. When the second currently-determined position P2 equals the previously determined position P2, the second comparison unit outputs the second error determination signal indicating that errors do not exist in the home position (i.e., operation 30).

To perform operation 26, the number of times generation inspection unit 64 inspects whether the first position P1 or the second position P2 is determined as many as n-times in response to the second error determination signal input from the second comparison unit 62 and outputs the inspection result to the error determination unit 66 as a third error determination signal. In particular, if it is judged through the second error determination signal from the second comparison unit 60 that the second currently-determined position P2 is not the same as the second previously-determined position P2, the number of times the generation inspection unit 64 inspects whether the first position P1 or the second position P2 is determined as many as n-times. In this case, the carriage movement unit 52 moves the carriage in the first direction in response to the third error determination signal input from the number of times generation inspection unit 64. For example, if it is recognized through the third error determination signal that the number of times of determining the first position P1 or the second position P2 is not n-times, the carriage movement unit 52 continues moving the carriage in the first direction.

To perform operation 28, the error determination unit 66 determines whether errors exist in the home position in response to the third error determination signal input from the number of times generation inspection unit 64 and outputs the result of determination to an output terminal OUT. For example, if it is recognized through the third error determination signal that the number of times of determining the first position P1 or the second position P2 is n-times, the error determination unit 66 determines that errors exists in the home position.

To perform operation 30, the error determination unit 66 determines whether errors exist in the home position in response to the second error determination signal input from the second comparison unit 62 and outputs the result of determination to the output terminal OUT. For example, if the second comparison unit 62 determines through the first error determination signal output from the first comparison unit 60 that the sum of the first position P1 and the second position P2 is the same as (equals) the maximum moving distance of the carriage, and if the error determination unit 66 determines through the second error determination signal output from the second comparison unit 62 that the second currently-determined position P2 is the same as the second previously-determined position P2 (operation 24), the error determination unit 66 determines that errors do not exist in the home position.

According to an aspect of the present invention, the apparatus inspecting a home position of an ink-jet printer carriage as shown in FIG. 3 may not include the number of times generation inspection unit 64. In this case, to perform operation 28, the error determination unit 66 determines whether errors exist in the home position in response to the first and second error determination signals from the first and second comparison units 60, 62, respectively, and outputs the result of determination to the output terminal OUT. For example, if, at operation 22, it is recognized through the first error determination signal that the distance between the first position P1 and the second position P2 is not the same as the maximum moving distance of the carriage, at operation 28, the error determination unit 66 determines that errors exist in the home position. Also, if, at operation 24, it is recognized through the second error determination signal that the second currently-determined position P2 is not the same as the second previously-determined position P2, at operation 28, the error determination unit 66 determines that errors exist in the home position (not shown in FIG. 2B).

According to an embodiment of the present invention, to perform operation 14, the position determination unit 54 sets the maximum moving distance of the carriage as the first position P1 in response to the first control signal C1 input from the movement inspection unit 50. For example, if it is recognized through the first control signal C1 that the carriage is not moved in the first direction for the first predetermined period of time, the position determination unit 54 determines the maximum moving distance of the carriage as the first position P1. In this case, to perform operation 16, the carriage movement unit 52 moves the carriage in the second direction in response to the position determination signal from the position determination unit 54 and counts the first position P1 downward. In this case, to perform operation 20, the position determination unit 54 determines the result of downward-counting input from the carriage movement unit 52 as the second position P2 in response to the second control signal C2 input from the movement inspection unit 50. For example, if it is recognized through the second control signal C2 that the carriage is not moved in the second direction for the second predetermined period of time, the position determination unit 54 determines the result of downward-counting, carried out by the carriage movement unit 52 just before the carriage is not moved, as the second position P2.

Typically, to perform operation 22, the first comparison unit 60, instead of comparing the sum of the first position P1 and the second position P2 input from the position addition unit 58 with the maximum moving distance of the carriage, compares the second position P2 input from the position determination unit 54 with '0' and outputs the result of comparison to the second comparison unit 62 and the error determination unit 66, respectively, as the first error determination signal. That is, if recognized, at operation 22, through the first error determination signal that the second position P2 is '0', at operation 24, the second comparison unit 62 compares the second currently-determined position P2 with the second previously-determined position P2. Also, when the apparatus inspecting a home position according to the present invention does not include the number of times generation inspection unit 64, if recognized, at operation 22, through the first error determination signal that the second position P2 is not '0', at operation 28, the error determination unit 66 determines that errors exist in the home position.

According to another embodiment of the present invention, to perform operation 14, the position determination unit 54 determines '0' as the first position P1 in response to the first control signal C1 input from the movement inspection unit 50. For example, if it is recognized through the first control signal C1 that the carriage is not moved in the first direction for the first predetermined period of time, the position determination unit 54 determines '0' as the first position P1. In this case, to perform operation 16, the carriage movement unit 52 moves the carriage in the second direction in response to the position determination signal from the position determination unit 54 and counts the first position P1 upward. In this case, to perform operation 20, the position determination unit 54 determines the result of upward-counting input from the carriage movement unit 52 as the second position P2 in response to the second control signal C2 input from the movement inspection unit 50. For example, if it is recognized through the second control signal C2 that the carriage is not moved in the second direction for the second predetermined period of time, the position determination unit 54 determines the result of upward-counting, carried out by the carriage movement unit 52 just before the carriage is not moved, as the second position P2.

Typically, to perform operation 22, the first comparison unit 60, instead of comparing the distance between the first position P1 and the second position P2 input from the position addition unit 58 with the maximum moving distance of the carriage, compares the second position P2 input from the position determination unit 54 with the maximum moving distance of the carriage and outputs the result of comparison to the second comparison unit 62 and the error determination unit 66, respectively, as the first error determination signal. That is, if recognized, at operation 22, through the first error determination signal that the second position P2 is the same as the maximum moving distance of the carriage, at operation 24 the second comparison unit 62 compares the second currently-determined position P2 with the second previously-determined position P2. Also, when the apparatus inspecting a home position according to the present invention does not include the number of times generation inspection unit 64, if recognized, at operation 22, through the first error determination signal that the second position P2 is not the same as the maximum moving distance of the carriage, at operation 28, the error determination unit 66 determines that errors exist in the home position.

As described above, in the method and the apparatus for inspecting a home position of an ink-jet printer carriage according to the present invention, if errors due to a foreign substance or other factors occur in calculating a home position of an ink-jet printer carriage that prints using a direct current (DC) motor driving the carriage, the errors are informed to a user so that the user can remove/handle the errors. Inspecting a home position of a printer carriage for errors according to the present invention can be advantageous, for example, when a bi-directional printing operation is performed, by improving printing quality with respect to movement of the printer carriage, and when a unidirectional printing operation is performed, by handling shifts in a starting position of the printing operation. More particularly, the present invention provides an ink-jet printer having a carriage driven by a direct current (DC) motor, the printer comprising a carriage mover moving the carriage in a first direction opposite to (away from) a home position of the carriage in response to a first control signal controlling the carriage movement, or moving the carriage in a second direction towards the home position, in response to a position determination signal and a second control signal controlling the carriage movement; a position determiner determining a current position of the carriage as a first position P1, using a maximum moving distance of the carriage, in response to the first control signal indicating that the carriage is not moved for a predetermined period of time, generating the position determination signal to the carriage mover to begin moving the carriage in the second direction, and determining a current position of the carriage as a second position P2, using the first position, in response to the second control signal indicating that the carriage is not moved for the predetermined period of time; a storage unit storing the second position; and a carriage error determiner 68 determining an error in the carriage home position if a sum of the first position and the second position is not same as the maximum moving distance of the carriage or a second currently-determined position is not same as a second previously-determined position read from the storage unit. Typically, the carriage error determiner 68 comprises the position adder 58, the first and second comparators 60, 62, and the error determiner 66. According to an aspect of the invention, the carriage error determiner 68 also comprises the number of times generation inspector 64. For example, the carriage mover stops moving the carriage in response to the first control signal or the second control signal indicating that the carriage is not moved for the predetermined period of time, and according to the calculated positions P1 and P2, the printer determines a carriage home position error due to, for example, a foreign substance in the printer blocking the carriage or because of a shift in a starting position of the carriage.

While this invention has been particularly shown and described with reference to a few embodiments thereof, it will be understood by those skilled in the art that various changes in form and details may be made therein without departing from the spirit and scope of the invention as defined by the appended claims and their equivalents.

What is claimed is:

1. A method of inspecting an ink-jet printer carriage home position, comprising:

moving the carriage in a first direction until the carriage is not moved for a first predetermined period of time and determining a current position of the carriage as a first position using a maximum moving distance of the carriage when the carriage is not moved for the first predetermined period of time;

moving the carriage in a second direction until the carriage is not moved for a second predetermined period of time and determining a current position of the carriage as a second position when the carriage is not moved for the second predetermined period of time;

determining that an error exist in the home position, if a distance between the first position and the second position is not same as the maximum moving distance of the carriage, or when a second currently-determined position is not same as a second previously-determined position; and determining that an error does not exist, if the distance between the first position and the second position is same as the maximum moving distance of the carriage and the second currently-determined position is same as the second previously-determined position;

wherein the first and second directions correspond to a direction away from the home position and to a direction towards the home position, respectively.

2. The method of claim 1, wherein the maximum moving distance of the carriage corresponds to a size of a frame installed on a moving route of the carriage.

3. The method of claim 1, wherein if the carriage is not moved in the first direction for the first predetermined period of time, the maximum moving distance of the carriage is determined as the first position, and the first position is counted downward while moving the carriage in the second direction, and if the carriage is not moved in the second direction for the second predetermined period of time, the downward-counting result, carried out until the carriage is not moved any more, is determined as the second position, and if the second position is '0' and the second currently-determined position is the same as the second previously-determined position, the error is determined not to exist in the home position, and if the second position is not '0', the error is determined to exist in the home position.

4. The method of claim 1, wherein, if the carriage is not moved in the first direction for the first predetermined period of time, '0' is determined as the first position, and the first position is counted upward while moving the carriage in the second direction, and if the carriage is not moved in the second direction for the second predetermined period of time, the upward-counting result, carried out until the carriage is not moved any more, is determined as the second position, and if the second position is the maximum moving distance of the carriage and the second currently-determined position is the same as the second previously-determined position, the home position error is determined not to exist, and if the second position is not the maximum moving distance of the carriage, the home position error is determined to exist.

5. The method of claim 1, wherein, when the distance between of the first position and the second position is not the same as the maximum moving distance of the carriage, or when the second currently-determined position is not the same as the second previously-determined position, if a number of times of determining the first position is not n-times, the carriage is moved in the first direction, and if the number of times of determining the first position is n-time, the home position error is determined to exist.

6. The method of claim 1, wherein, when the distance between the first position and the second position is not the same as the maximum moving distance of the carriage, or when the second currently-determined position is not the same as the second previously-determined position, if a number of times of determining the second position is not n-times, the carriage is moved in the first direction, and if the number of times of determining the second position is n-times, the home position error is determined to exist.

7. The method of claim 1, wherein the first predetermined period of time is same as the second predetermined period of time.

8. An apparatus included in an ink-jet printer having a carriage driven by a direct current (DC) motor and inspecting a home position of the carriage, the apparatus comprising:

a carriage mover moving the carriage in a first direction away from a home position of the carriage in response to a first control signal or moving the carriage in a second direction towards the home position, in response to a position determination signal and a second control signal;

a movement inspector inspecting whether the carriage is moved in the first direction, outputs a result of the inspection as the first control signal, inspects whether the carriage is moved in the second direction, and outputs a result of the second direction inspection as the second control signal;

a position determiner determining a current position of the carriage as a first position, using a maximum moving distance of the carriage, in response to the first control signal from the movement inspector, generating the position determination signal, which indicates whether the first position is determined, to the carriage mover to begin moving the carriage in the second direction, and determining a current position of the carriage as a second position, using the first position, in response to the second control signal from the movement inspector;

a storage unit storing the second position;

a position adder calculating the distance between the first position and the second position;

a first comparator comparing the distance between the first position and the second position input from the position addition unit with the maximum moving distance of the carriage and outputting a result of the comparing as a first error determination signal;

a second comparator comparing a second currently-determined position input from the position determiner with the second previously-determined position read from the storage unit and outputting a result of the comparing as a second error determination signal, in response to the first error determination signal; and an error determiner determining whether an error exists in the home position in response to the first and second error determination signals.

9. The apparatus of claim 8, wherein the carriage mover moves the carriage in the second direction in response to the position determination signal and the second control signal and counts the first position downward, the position determination unit determines the maximum moving distance of the carriage as the first position in response to the first control signal, outputs the position determination signal, and determines a result of the downward-counting input from the carriage mover as the second position, in response to the second control signal, and the first comparison unit compares the second position with '0' and outputs a result of the comparing as the first error determination signal.

10. The apparatus of claim 8, wherein the carriage mover moves the carriage in the second direction in response to the position determination signal and the second control signal and counts the first position upward, the position determination unit determines '0' as the first position in response to the first control signal, outputs the position determination signal and determines a result of the upward-counting input from the carriage mover as the second position, in response to the second control signal, and the first comparison unit compares the second position with the maximum moving distance of the carriage and outputs a result of the comparing as the first error determination signal.

11. The apparatus of claim 8, further comprising a generation times inspector inspecting whether the first position is determined n-times in response to the second error determination signal and outputs a result of the inspecting as a third error determination signal, wherein the carriage mover moves the carriage in the first direction in response to the third error determination signal, and the error determination unit determines whether the error exists in the home position in response to the third error determination signal.

12. The apparatus of claim 8, further comprising a generation times inspector inspecting whether the second position is determined n-times in response to the second error determination signal and outputs a result of the inspecting as a third error determination signal, wherein the carriage mover moves the carriage in the first direction in response to the third error determination signal, and the error determination unit determines whether the error exists in the home position in response to the third error determination signal.

13. An ink-jet printer having a carriage driven by a direct current (DC) motor, the printer comprising:

a carriage mover moving the carriage in a first direction opposite to a home position of the carriage in response to a first control signal controlling the carriage movement or moving the carriage in a second direction of the home position, in response to a position determination signal and a second control signal controlling the carriage movement;

a position determiner determining a current position of the carriage as a first position, using a maximum moving distance of the carriage, in response to the first control signal indicating that the carriage is not moved for a predetermined period of time in the first direction, generating the position determination signal to the carriage mover to begin moving the carriage in the second direction, and determining a current position of the carriage as a second position, using the first position, in response to the second control signal indicating that the carriage is not moved for the predetermined period of time in the second direction;

a storage unit storing the second position; and a carriage error determiner determining an error in the carriage home position if a sum of the first position and the second position is not same as the maximum moving distance of the carriage or a second currently-determined position is not same as a second previously-determined position read from the storage unit.

14. The printer of claim 13, wherein the carriage mover moves the carriage in the second direction in response to the position determination signal and the second control signal and counts the first position downward, the position determination signal determines the maximum moving distance of the carriage as the first position in response to the first control signal indicating that the carriage is not moved for a predetermined period of time in the first direction, outputs the position determination signal, and determines a result of the downward-counting as the second position, in response to the second control signal indicating that the carriage is not moved for a predetermined period of time in the second direction, and the carriage error determiner compares the second position with '0' to determine the error in the carriage home position.

15. The printer of claim 13, wherein the carriage mover moves the carriage in the second direction in response to the position determination signal and the second control signal and counts the first position upward, the position determination signal determines '0' as the first position in response to the first control signal indicating that the carriage is not moved for a predetermined period of time in the first direction, outputs the position determination signal, and determines a result of the upward-counting input as the second position, in response to the second control signal indicating that the carriage is not moved for a predetermined period of time in the second direction, and the carriage error determiner compares the second position with the maximum moving distance of the carriage to determine the error in the carriage home position.

16. The printer of claim 13, wherein the carriage mover stops moving the carriage in response to the first control signal or the second control signal indicating that the carriage is not moved for the predetermined period of time.

17. A method of inspecting a home position of an ink-jet printer having a carriage, the method comprising:

moving the carriage in a first direction;

determining a current position of the carriage as a first position when the carriage is not moved for a first predetermined period of time;

moving the carriage in a second direction opposite to the first direction;

determining a current position of the carriage as a second position when the carriage is not moved for a second predetermined period of time;

comparing a distance between the first position and the second position with a maximum moving distance of the carriage;

comparing the second position with a second currently-determined position; and if the distance between the first position and the second position is not the same as the maximum moving distance of the carriage or if the second position is not the same as the second currently-determined position, determining that an error exists in the home position.

18. The method of claim 17, further comprising informing a user that an error exists in the home position.

* * * * *

UNITED STATES PATENT AND TRADEMARK OFFICE

CERTIFICATE OF CORRECTION

PATENT NO. : 7,144,094 B2
APPLICATION NO. : 10/673482
DATED : December 5, 2006
INVENTOR(S) : Jin-tae Chung It is certified that error appears in the above-identified patent and that said Letters Patent is hereby corrected as shown below:

TITLE PG, ITEM (57) (Abstract), Line 13, after "second" insert --currently-determined--.

Column 12, Line 23, after "between" delete "of".

Signed and Sealed this

Third Day of April, 2007

JON W. DUDAS
*Director of the United States Patent and Trademark Office*